US010142737B2

(12) United States Patent
Li et al.

(10) Patent No.: US 10,142,737 B2
(45) Date of Patent: Nov. 27, 2018

(54) MINI LOUDSPEAKER

(71) Applicant: GOERTEK INC., Weifang, Shandong (CN)

(72) Inventors: Guiling Li, Shandong (CN); Zhenjin Ren, Shandong (CN)

(73) Assignee: GOERTEK INC., Weifang, Shandong (CN)

( * ) Notice: Subject to any disclaimer, the term of this patent is extended or adjusted under 35 U.S.C. 154(b) by 0 days.

(21) Appl. No.: 15/541,582

(22) PCT Filed: Dec. 18, 2015

(86) PCT No.: PCT/CN2015/097854

§ 371 (c)(1),
(2) Date: Jul. 5, 2017

(87) PCT Pub. No.: WO2016/206328

PCT Pub. Date: Dec. 29, 2016

(65) Prior Publication Data

US 2017/0374471 A1 Dec. 28, 2017

(30) Foreign Application Priority Data

Jun. 23, 2015 (CN) ..... 2015 1 0350108

(51) Int. Cl.
*H04R 9/02* (2006.01)
*H04R 9/06* (2006.01)
*H04R 31/00* (2006.01)

(52) U.S. Cl.
CPC ..... *H04R 9/06* (2013.01); *H04R 9/02* (2013.01); *H04R 9/025* (2013.01); *H04R 31/00* (2013.01);

(Continued)

(58) Field of Classification Search
CPC ..... H04R 9/06; H04R 9/025; H04R 31/003
See application file for complete search history.

(56) References Cited

U.S. PATENT DOCUMENTS 7,869,839 B2 * 1/2011 Jung ..... H04M 1/18 455/575.1

FOREIGN PATENT DOCUMENTS

CN 103763641 A 4/2014
CN 203618119 U 5/2014

(Continued)

OTHER PUBLICATIONS

First Chinese Office Action regarding Application No. 201510350108.8 dated Jul. 19, 2017.

(Continued)

*Primary Examiner* — Brian Ensey
(74) *Attorney, Agent, or Firm* — U.S. Fairsky LLP; Yue (Robert) Xu

(57) ABSTRACT

A mini loudspeaker includes a shell, a vibration system and a magnetic circuit system are received in the shell, and the shell is made up by jointing at least two shell bodies. A protruding sealing portion is provided on one of the shell bodies at a portion where the shell body is sealed with another shell body, the sealing portion is formed integrally with the shell body by bi-color injection molding process, material of the sealing portion has a hardness smaller than hardness of material of the shell body and has compressibility; the shell body is further provided with a jointing component configured to join the shell body to another shell body, and the jointing component and the sealing portion are located on the same side. The mini loudspeaker addresses the sealing issue of products under the condition of a small space and has a good sealing performance.

11 Claims, 7 Drawing Sheets

(52) U.S. Cl.
CPC ..... *H04R 31/003* (2013.01); *H04R 2400/11* (2013.01); *H04R 2499/11* (2013.01)

(56) References Cited

FOREIGN PATENT DOCUMENTS

| | | | |
|---|---|---|---|
| CN | 204131709 | U | 1/2015 |
| CN | 104936109 | A | 9/2015 |
| CN | 204733373 | U | 10/2015 |
| CN | 204810544 | U | 11/2015 |
| EP | 0251057 | A1 | 1/1988 |
| JP | 2007027923 | A | 2/2007 |

OTHER PUBLICATIONS

International Search Report for PCT/CN2015/097854, dated Mar. 14, 2016, ISA/CN.

* cited by examiner

MINI LOUDSPEAKER

This application is the national phase of International Application No. PCT/CN2015/097854, titled "MINI LOUDSPEAKER", filed on Dec. 18, 2015 which claims the benefit of priority to Chinese Patent Application No. 201510350108.8 titled "MINI LOUDSPEAKER", filed with the Chinese State Intellectual Property Office on Jun. 23, 2015, the entire disclosures of which applications are incorporated herein by reference.

FIELD

The present application relates to the technical field of electro-acoustic products, and particularly relates to a mini loudspeaker.

BACKGROUND

A mini loudspeaker is an important acoustic component of a portable electronic device for achieving conversion between electrical signals and sound signals, and thus is an energy conversion device. A conventional mini loudspeaker generally includes a shell, which is generally formed by jointing at least two shell bodies, and a vibration system and a magnetic circuit system are received in a space defined by the shell bodies together. In order to ensure the acoustic performance of the mini loudspeaker, the shell bodies should not only be fixedly jointed but also be sealed. At present, the sealing between the two shell bodies is achieved generally by ultrasonic welding or adhesive sealing.

With the miniaturization of the portable electronic device, mini loudspeaker, as a main acoustic component of the portable electronic device, is becoming smaller and smaller accordingly. With the volume of the shell of the mini loudspeaker becoming smaller and smaller, some shell bodies may have no space for arranging an ultrasonic wire for ultrasonic sealing. Therefore, it is more and more difficult to achieve sealing between the two shell bodies. Besides, sealing by the conventional ultrasonic welding or adhesive sealing may cause the following drawbacks.

As shown in FIG. 1, two shell bodies 100 are bonded and sealed by a sealant 102, and the sealant 102 may overflow towards both inside and outside of the shell bodies. As shown in FIG. 2, the two shell bodies 100 are sealed by the ultrasonic welding process, during which the melted ultrasonic wire 104 may also overflow towards both inside and outside of the shell bodies. In the case that the sealant and the melted ultrasonic wire overflow to the inside of the shell bodies, the volume of an inner chamber of the mini loudspeaker may be reduced, therefore, the acoustic performance of the mini loudspeaker and installation positions of the internal components may be adversely affected. In the case that the sealant and the melted ultrasonic wire overflow to the outside of the shell bodies, it may adversely affect the appearance of the mini loudspeaker, to locally increase the external dimension of the mini loudspeaker, thereby adversely affecting the assembly of the mini loudspeaker in the portable electronic device.

SUMMARY

In view of the above drawbacks, a technical issue to be addressed by the present application is to provide a mini loudspeaker, which has a good sealing performance between the shell bodies, and an inner chamber and an appearance at the joint of the two shell bodies have such good quality that the issues of adhesive overflowing or material overflowing may not exist.

For addressing the above technical issues, the technical solutions in the present application are as follows.

A mini loudspeaker includes a shell, and a vibration system and a magnetic circuit system which are received in the shell, and the shell is made up by jointing at least two shell bodies. A protruding sealing portion is provided on one of the shell bodies at a portion where the shell body is sealed with another one of the shell bodies, the sealing portion is formed integrally with the shell body by bi-color injection molding process, the material of the sealing portion has a hardness smaller than the hardness of the material of the shell body, and the sealing portion has a compressibility; the shell body is further provided with a jointing component configured to joint the shell body to another one of the shell bodies, and the jointing component and the sealing portion are located on the same side of the shell body.

Specifically, the structure of the sealing portion is ring-shaped, and the jointing component is located at an outer side of the sealing portion.

Specifically, the shell body provided with the sealing portion and the jointing component has a rectangular structure, the number of the jointing component is four, and the four jointing components are arranged on four corners of the shell body respectively.

As an embodiment, the jointing components are ultrasonic wires, and the shell body is jointed to another one of the shell bodies by ultrasonic welding process.

Specifically, the shell includes a first shell body, a second shell body, and a third shell body which are successively jointed together, and the ultrasonic wires and the sealing portion are both provided on the third shell body.

As a further embodiment, the jointing components are hot-melt columns, and hot-melt holes are provided in another one of the shell bodies at positions corresponding to the hot-melt columns respectively, and the shell body is jointed to the another shell body by hot-melt process.

Specifically, the shell includes a first shell body, a second shell body, and a third shell body which are successively jointed together, the hot-melt columns and the sealing portion are all located on the third shell body, and the hot-melt holes are located in the second shell body.

Specifically, the second shell body and the third shell body are both injection molded shell bodies.

Specifically, the shell includes a first shell body and a second shell body jointed together, the hot-melt columns and the sealing portion are both located on the second shell body, the hot-melt holes are located in the first shell body, and the first shell body is a metal shell body.

Specifically, the material of the sealing portion is one of silica gel, thermoplastic polyurethanes, thermoplastic composites or thermoplastic rubber.

With the technical solutions described above, the beneficial effects of the present application are as follows.

The mini loudspeaker according to the present application includes a shell made up by jointing at least two shell bodies, a protruding sealing portion is provided on one of the shell bodies at a portion where the shell body is sealed with another one of the shell bodies, the sealing portion is formed integrally with the shell body by bi-color injection molding process, the material of the sealing portion has a small hardness and also has compressibility; the shell body is further provided with a jointing component configured to joint the shell body to another one of the shell bodies, the jointing component and the sealing portion are located on the same side of the shell body. Thus, by injection molding the sealing portion having compressibility on one shell body through bi-color injection molding process, the sealing portion is extruded by the two shell bodies in the case that the two shell bodies are fixedly jointed together into one piece by the jointing component, thus the sealing portion comes into a close contact with another shell body, thereby achieving the sealing between the two shell bodies. This sealing method addresses the sealing issue of a product under the condition of a small space, can ensure a good sealing performance and avoids the issue of adhesive or material overflowing, ensures a good quality of the inner chamber and an esthetic appearance of the mini loudspeaker, thereby ensuring the acoustic performance of the mini loudspeaker and smooth assembly of the mini loudspeaker with the portable electronic device.

In view of the above, the mini loudspeaker according to the present application addresses the technical issue of poor sealing between the shell bodies of the mini loudspeaker in the conventional technology. The mini loudspeaker according to the present application addresses the sealing issue of a product under the condition of a small space and has a good sealing performance, and also ensures a good quality of the inner chamber and an esthetic appearance of the mini loudspeaker.

BRIEF DESCRIPTION OF THE DRAWINGS

For more clearly illustrating the technical solutions of embodiments of the present application or in the conventional technology, drawings referred to describe the embodiments or the conventional technology will be briefly described hereinafter. Apparently, the drawings in the following description are only several embodiments of the present application, and for those skilled in the art, other drawings may be obtained based on these drawings without any creative efforts

REFERENCE NUMERALS IN THE DRAWINGS

| | | | |
|---|---|---|---|
| 10a | first shell body, | 10b | first shell body, |
| 20a | second shell body, | 20b | second shell body, |
| 22 | hot-melt hole, | 30a | third shell body, |
| 30b | third shell body, | 32 | sealing portion, |
| 34 | ultrasonic wire, | 36 | hot-melt column, |
| 40 | first shell body, | 42 | hot-melt hole, |
| 50 | second shell body, | 52 | sealing portion, |
| 54 | hot-melt column, | 100 | shell body, |
| 102 | sealant, and | 104 | melted ultrasonic wire. |

DETAILED DESCRIPTION

The present application is further described with reference to the drawings and embodiments hereinafter.

In the description, the term "inside" refers to a side close to the center of the shell body, and the term "outside" refers to a side away from the center of the shell.

First Embodiment

Figure 1:
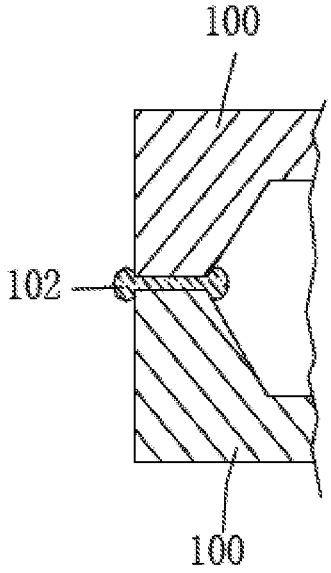
Figure 1 Prior art
FIG. 1 is a schematic view showing the structure of shell bodies sealed by a sealant according to the conventional technology.
Figure 2:
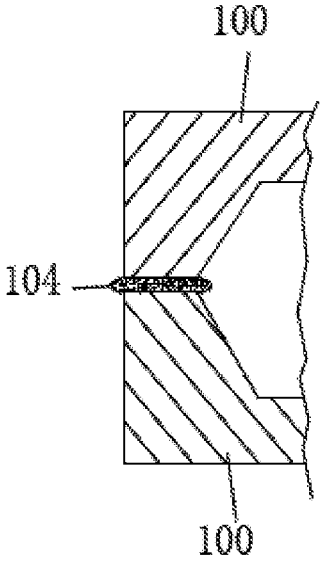
Figure 2 Prior art
FIG. 2 is a schematic view showing the structure of shell bodies sealed by ultrasonic welding according to the conventional technology.
Figure 3:
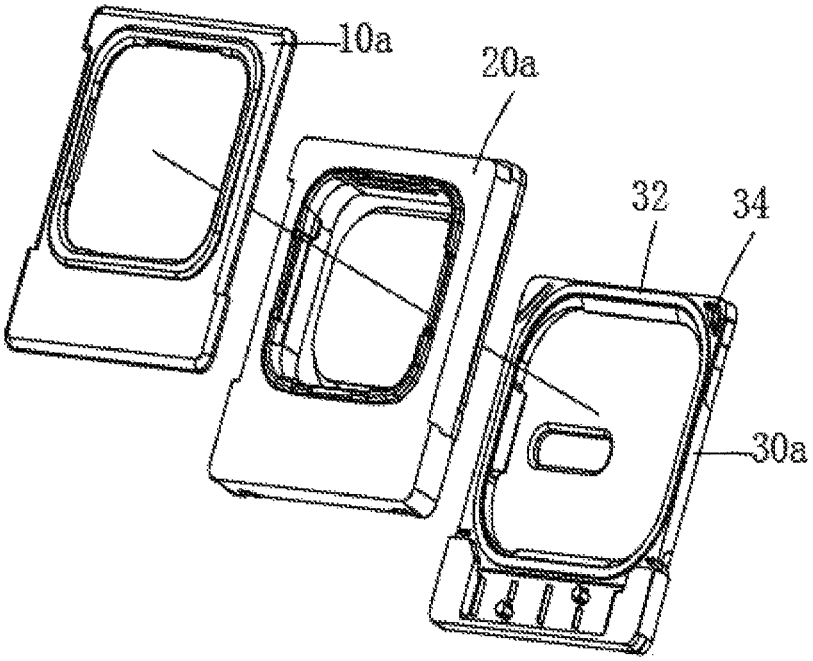
FIG. 3 is a schematic exploded view showing the structure of shell bodies of a mini loudspeaker according to a first embodiment of the present application.
Figure 4:
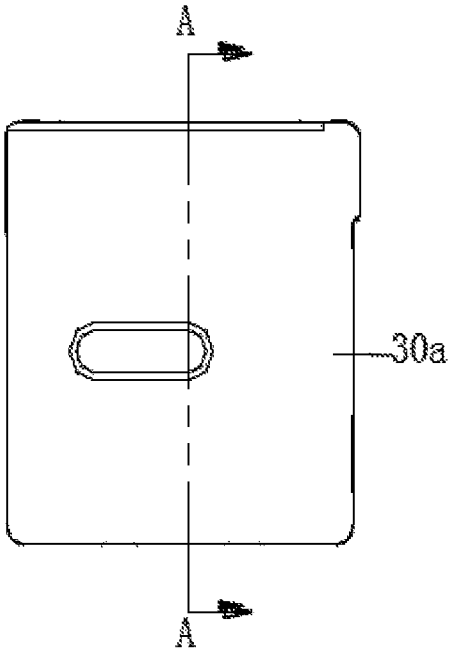
FIG. 4 is a view showing the shell bodies in FIG. 3 after being assembled.
Figure 5:
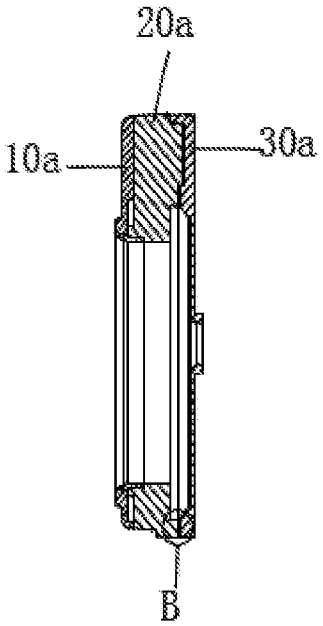
FIG. 5 is a sectional view taken along line A-A in FIG. 4.

As shown in FIGS. 3, 4 and 5 together, a mini loudspeaker has a rectangular structure, including a shell which is made up of a first shell body 10*a*, a second shell body 20*a* and a third shell body 30*a* successively jointed together. A vibration system and a magnetic circuit system (not shown) are received in a space defined by the first shell body 10*a*, the second shell body 20*a* and the third shell body 30*a* together. The first shell body 10*a*, the second shell body 20*a* and the third shell body 30*a* are respectively injection molded shell bodies.

Figure 7:
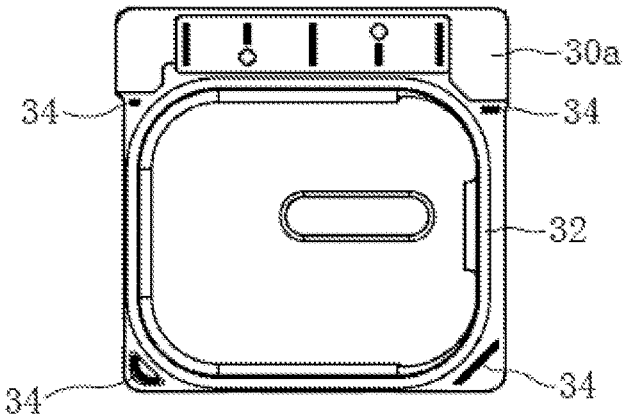
FIG. 7 is a schematic view showing the structure of a third shell body in FIG. 3.

As shown in FIGS. 3 and 7 together, a protruding sealing portion is provided at an edge portion, at a side where the third shell body 30*a* is jointed with the second shell body 20*a*, of the third shell body 30*a*, and the protruding sealing portion 32 has a rectangular ring-shaped structure with round corners. The sealing portion 32 and a main body of the third shell body 30*a* are integrally molded by bi-color injection molding process, the material of the sealing portion 32 has a hardness smaller than that of the material of the main body of the third shell body 30*a*. The sealing portion 32 has a certain compressibility and elasticity, and material of the sealing portion 32 is, but not limit to, one of silica gel, TPU (Thermoplastic Polyurethanes), TPC (Thermoplastic Composites) or TPR (Thermoplastic Rubber). Any materials may be used as the materials of the sealing portion as long as the material is soft, has a compressibility and elasticity, and can be used in injection molding process.

As shown in FIGS. 3 and 7 together, a jointing component is further provided on one side, provided with the sealing portion 32, of the third shell body 30*a* (i.e., the side where the third shell body 30*a* is jointed to the second shell body 20*a*), and the third shell body 30*a* is jointed to the second shell body 20*a* by the jointing component to form an integrated body. In this embodiment, the jointing component is an ultrasonic wire 34, and there are four ultrasonic wires 34 respectively arranged on four corners at an outer side of the sealing portion 32. The third shell body 30*a* is jointed to the second shell body 20*a* by ultrasonic welding process.

Figure 6:
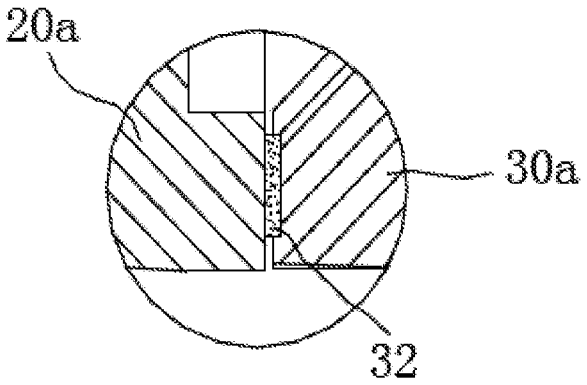
FIG. 6 is an enlarged view of part B in FIG. 5.

As shown in FIGS. 5 and 6 together, after the third shell body 30*a* is jointed to the second shell body 20*a*, the sealing portion 32 is extruded by the second shell body 20*a* and the third shell body 30*a*. Since the material of the sealing portion 32 is soft and has a certain elasticity, the sealing portion 32, under the effect of extrusion force applied by the two shell bodies, is compressed and deformed to be in a close contact with the second shell body 20*a*, thereby achieving a sealing between the third shell body 30*a* and the second shell body 20*a*. Since each of the four ultrasonic wires 34 is short and located at the corner having a relatively large space, of the third shell body 30*a*, the material overflowing phenomenon may not occur after the ultrasonic wires 34 are melted, thus ensuring a good quality of the inner chamber and an esthetic appearance of the mini loudspeaker on the premise of achieving the sealing between the shell bodies. In practical application, the sealing portion and the jointing component may also be provided between the first shell body 10*a* and the second shell body 20*a* to achieve the jointing and sealing between the first shell body 10*a* and the second shell body 20*a*.

Second Embodiment

This embodiment is substantially the same as the first embodiment, except for the following different aspects.

Figure 8:
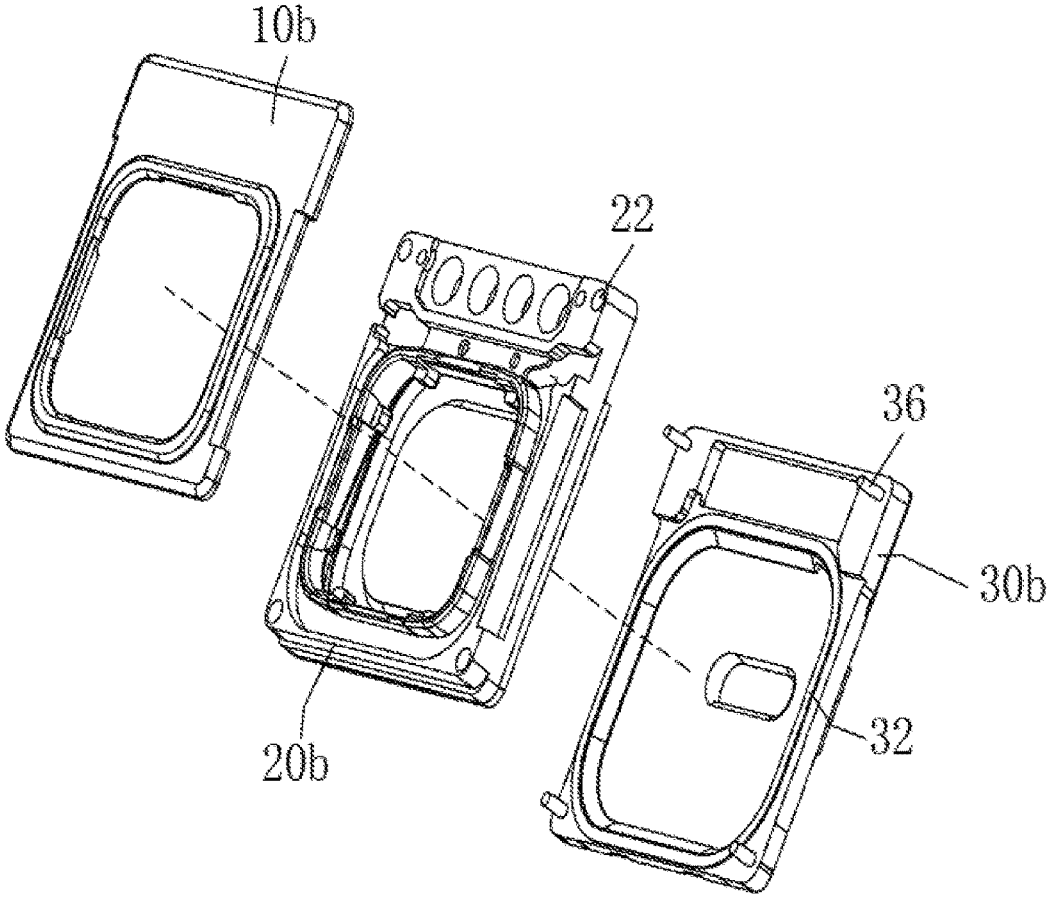
FIG. 8 is a schematic exploded view showing the structure of shell bodies of a mini loudspeaker according to a second embodiment of the present application.
Figure 9:
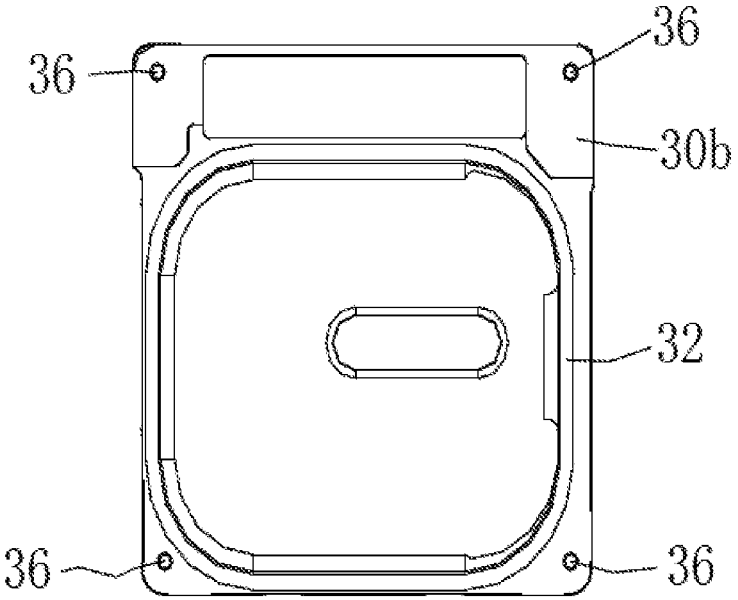
FIG. 9 is a schematic view showing the structure of a third shell body in FIG. 8.

As shown in FIGS. 8 and 9 together, the shell of the mini loudspeaker is made up of a first shell body 10*b*, a second shell body 20*b* and a third shell body 30*b* which are successively jointed together, and a sealing portion 32 and a jointing component are both provided on the third shell body 30*b*. In this embodiment, the jointing component is hot-melt columns 36 respectively arranged on four corners of the third shell body 30*b*, and four corners of the second shell body 20*b* are respectively provided with hot-melt holes 22 at positions respectively corresponding to the hot-melt columns 36. The third shell body 30*b* and the second shell body 20*b* are jointed into one piece by hot-melt process, and the sealing therebetween is achieved by the sealing portion 32.

Third Embodiment

This embodiment is substantially the same as the second embodiment except for the following different aspects.

Figure 10:
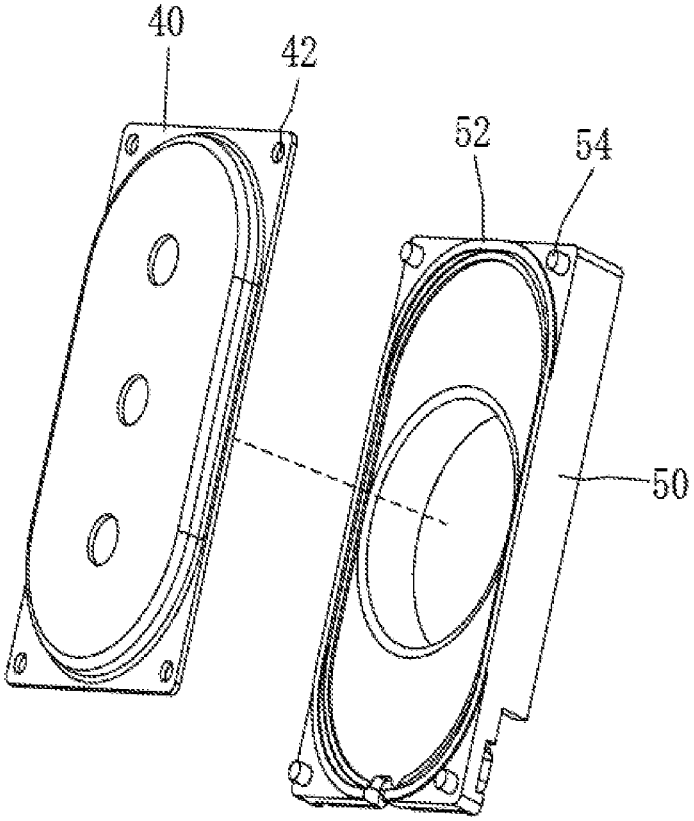
FIG. 10 is a schematic exploded view showing the structure of shell bodies of a mini loudspeaker according to a third embodiment of the present application.
Figure 11:
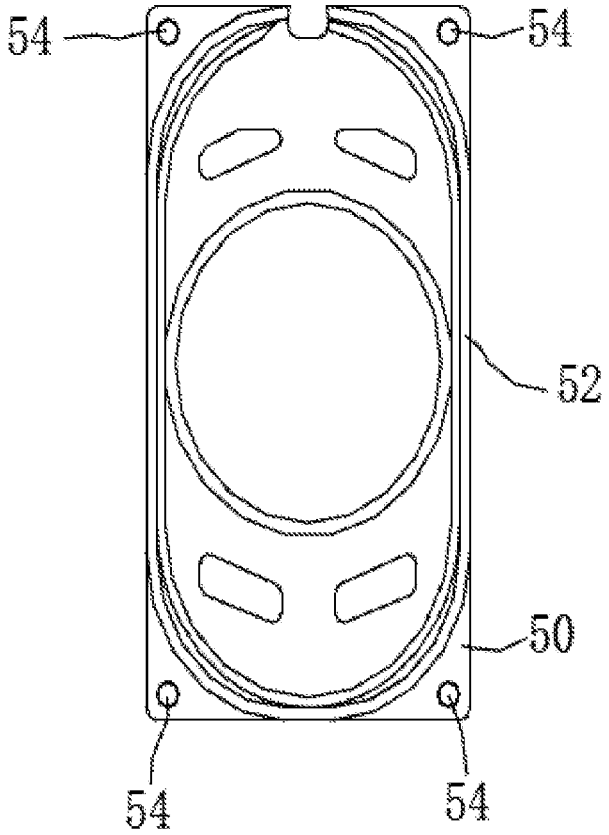
FIG. 11 is a schematic view showing the structure of a second shell body in FIG. 10.

As shown in FIGS. 10 and 11 together, a shell of the mini loudspeaker is made up of a first shell body 40 and a second shell body 50 which are jointed together, and a sealing portion 52 and hot-melt columns 54 are all provided on the second shell body 50. The sealing portion 52 is provided on an edge portion of the second shell body 50 and is a track-like ring-shaped structure. Four hot-melt columns 54 are provided on four corners outside the sealing portion 52 respectively. The first shell body 40 is provided with hot-melt holes 42 respectively at positions corresponding to the four hot-melt columns 54 respectively. The first shell body 40 is a metal shell body. The first shell body 40 is jointed to the second shell body 50 by hot-melt process, and the sealing therebetween is achieved by the sealing portion 52.

In the present application, a soft ring-shaped sealing portion is injection molded on a portion of a shell body where the shell body is sealed with another shell body by bi-color injection molding process, thereby achieving a good sealing between two shell bodies by extrusion to the sealing portion by the two shell bodies. Besides, compared with the adhesive sealing in the conventional technology, a step of applying adhesive is omitted in this process, the assembly process is simplified, and the issue of adhesive overflowing is avoided, thereby ensuring the good quality of the inner chamber and an esthetic appearance of the mini loudspeaker. In addition, compared with the ultrasonic welding process in the conventional technology, this process will not cause the issue of material overflowing, and also ensures the good quality of the inner chamber and esthetic appearance of the mini loudspeaker, thus further ensuring the acoustic performance of the mini loudspeaker and a smooth assembly with the portable electronic device, thereby effectively addressing the sealing issue of a product under the condition of a small space.

The above embodiments of the present application are merely illustrative examples of the technical solution of the present application using bi-color injection molding process to achieve sealing between the shell bodies, the shell body structure of the mini loudspeaker is not limited to the above rectangular structure, it may also be round, track-like structure and the like. The technical solution of the present application can be applied to the sealing between any kind of mini loudspeaker shell bodies, and those skilled in the art can apply the technical solutions of the present application to mini loudspeakers with other structures based on the description of the above embodiments without any creative efforts. Therefore, regardless of whether other structures of the mini loudspeaker are the same as that of the above embodiments, as long as the product employs the bi-color injection molding process to achieve the sealing between the shell bodies to simplify the assembly process and improve the quality of the inner chamber and outer appearance of the mini loudspeaker, the product falls into the scope of the present application.

Names of the features with serials numbers (e.g., the first shell body, the second shell body, and the third shell body) involved in the present application are only intended to distinguish technical features and do not represent the positional relationship between the features, assembly sequence and work sequence and the like.

The present application is not limited to the above embodiments, and various variations made by those skilled in the art based on the above concepts without any creative efforts all fall into the scope of the present application.

The invention claimed is:

1. A mini loudspeaker, comprising a shell, and a vibration system and a magnetic circuit system which are received in the shell, wherein the shell is made up by jointing at least two shell bodies, a protruding sealing portion is provided on a first shell body of the shell bodies at a portion where the first shell body is sealed with a second shell body of the shell bodies, the sealing portion is formed integrally with the first shell body by bi-color injection molding process, material of the sealing portion has a hardness smaller than the hardness of material of the first shell body, and the sealing portion has a compressibility; and the first shell body is further provided with a jointing component configured to join the first shell body to the second shell body of the shell bodies and the jointing component is arranged at an outer side of the sealing portion, and the jointing component and the sealing portion are located on the same side of the first shell body.

2. The mini loudspeaker according to claim 1, wherein the structure of the sealing portion is ring-shaped, and the jointing component is located at an outer side of the sealing portion.

3. The mini loudspeaker according to claim 2, wherein the first shell body provided with the sealing portion and the jointing component has a rectangular structure, the number of the jointing component is four, and the four jointing components are arranged on four corners of the first shell body respectively.

4. The mini loudspeaker according to claim 3, wherein the jointing components are ultrasonic wires, and the first shell body is jointed to the second shell body of the shell bodies by ultrasonic welding process.

5. The mini loudspeaker according to claim 4, wherein the shell comprises the first shell body, the second shell body and a third shell body which are successively jointed together, and the ultrasonic wire and the sealing portion are both provided on the first shell body.

6. The mini loudspeaker according to claim 3, wherein the jointing components are hot-melt columns, hot-melt holes are provided in the second shell body of the shell bodies at positions corresponding to the hot-melt columns respectively, and the first shell body is jointed to the second shell body of the shell bodies by hot-melt process.

7. The mini loudspeaker according to claim 6, wherein the shell comprises the first shell body, the second shell body and a third shell body which are successively jointed together, the hot-melt columns and the sealing portion are both located on the first shell body, and the hot-melt holes are located in the second shell body.

8. The mini loudspeaker according to claim 5, wherein the second shell body and the first shell body are both injection molded shell bodies.

9. The mini loudspeaker according to claim 6, wherein the shell comprises the first shell body and the second shell body jointed together, the hot-melt columns and the sealing portion are both located on the second shell body, the hot-melt holes are located in the third shell body, and the third shell body is a metal shell body.

10. The mini loudspeaker according to claim 1, wherein the material of the sealing portion is one of silica gel, thermoplastic polyurethanes, thermoplastic composites or thermoplastic rubber.

11. The mini loudspeaker according to claim 7, wherein the second shell body and the first shell body are both injection molded shell bodies.

* * * * *